US006688867B2

(12) United States Patent
Suman et al.

(10) Patent No.: US 6,688,867 B2
(45) Date of Patent: Feb. 10, 2004

(54) ROTARY BLOWER WITH AN ABRADABLE COATING

(75) Inventors: Andrew W. Suman, Waterford, MI (US); Matthew G. Swartzlander, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/971,252

(22) Filed: Oct. 4, 2001

(65) Prior Publication Data

US 2003/0086804 A1 May 8, 2003

(51) Int. Cl.[7] ..... F01C 21/00

(52) U.S. Cl. ..... 418/178; 418/206.9; 428/414; 428/614; 427/546

(58) Field of Search ..... 418/206.9, 178; 428/414, 614; 427/546

(56) References Cited

U.S. PATENT DOCUMENTS

| | | | | | |
|---|---|---|---|---|---|
| 2,754,050 | A | * | 7/1956 | Wellington | 418/178 |
| 3,090,696 | A | | 5/1963 | Gemmer | |
| 3,535,057 | A | | 10/1970 | Kodra | |
| 4,139,376 | A | | 2/1979 | Erickson et al. | |
| 4,274,811 | A | | 6/1981 | Rao | |
| 4,291,089 | A | | 9/1981 | Adamovic | |
| 4,350,135 | A | | 9/1982 | Casey et al. | |
| 4,509,906 | A | * | 4/1985 | Hattori et al. | 418/152 |
| 4,645,440 | A | | 2/1987 | Murata et al. | |
| 4,667,769 | A | | 5/1987 | Appel | |
| 4,671,735 | A | | 6/1987 | Rossmann et al. | |
| 4,692,382 | A | * | 9/1987 | Schmitt et al. | 428/414 |
| 4,717,322 | A | | 1/1988 | Masuda et al. | |
| 4,735,556 | A | | 4/1988 | Fujikake et al. | |
| 4,764,098 | A | | 8/1988 | Iwase et al. | |
| 4,806,387 | A | | 2/1989 | Tamaki et al. | |
| 4,806,388 | A | | 2/1989 | Mochizuki et al. | |
| 4,828,467 | A | | 5/1989 | Brown | |
| 4,985,326 | A | * | 1/1991 | Sakamoto | 430/96 |
| 5,017,402 | A | | 5/1991 | McComas | |
| 5,073,213 | A | | 12/1991 | Pfestorf | |
| 5,118,268 | A | | 6/1992 | Crisenbery et al. | |
| 5,153,021 | A | | 10/1992 | Litchfield et al. | |
| 5,196,471 | A | | 3/1993 | Rangaswamy et al. | |
| 5,284,123 | A | | 2/1994 | Dones | |
| 5,290,150 | A | | 3/1994 | Takahashi et al. | |
| 5,320,508 | A | | 6/1994 | Kiefer | |
| 5,377,407 | A | | 1/1995 | Takahashi et al. | |
| 5,421,087 | A | * | 6/1995 | Newkirk et al. | 428/614 |
| 5,434,210 | A | | 7/1995 | Rangaswamy et al. | |
| 5,469,777 | A | | 11/1995 | Rao et al. | |
| 5,472,315 | A | | 12/1995 | Alexander et al. | |
| 5,477,820 | A | * | 12/1995 | Rao | 123/193.2 |
| 5,530,050 | A | | 6/1996 | Rangaswamy | |
| 5,536,022 | A | | 7/1996 | Sileo et al. | |
| 5,554,020 | A | | 9/1996 | Rao et al. | |
| 5,566,450 | A | * | 10/1996 | Rao et al. | 29/888.061 |
| 5,638,600 | A | | 6/1997 | Rao et al. | |
| 5,772,418 | A | | 6/1998 | Tateno et al. | |

(List continued on next page.)

FOREIGN PATENT DOCUMENTS

| | | |
|---|---|---|
| JP | 62048984 | 3/1987 |
| JP | 04101078 | 2/1992 |
| JP | 11148478 | 2/1999 |

*Primary Examiner*—Thomas Denion
*Assistant Examiner*—Theresa Trieu
(74) *Attorney, Agent, or Firm*—Daniel S. Kalka; L. J. Kasper

(57) ABSTRACT

An improved rotary blower (11) with an abradable coating (61) with a maximum hardness value of 2H on a pencil hardness scale. The coating material is a blend or mixture of preferably an epoxy-polymer resin matrix with a solid lubricant. The solid lubricant preferably is graphite. The improved abradable coating provides essentially zero clearance to increase the volumetric efficiency of a Roots type rotary blower.

21 Claims, 4 Drawing Sheets

U.S. PATENT DOCUMENTS 5,879,753 A 3/1999 Zajchowski et al.
5,887,576 A 3/1999 Wheeler, Jr. et al.
5,938,420 A 8/1999 Teraoka
5,970,611 A 10/1999 Takabe et al.
5,976,695 A 11/1999 Hajmrle et al.
6,050,797 A 4/2000 Zhong
6,095,783 A 8/2000 Hansen et al.
6,142,759 A 11/2000 Tateno et al.

* cited by examiner

ROTARY BLOWER WITH AN ABRADABLE COATING

BACKGROUND OF THE INVENTION

1. Field of the Invention

The present invention relates in general to an improved rotary blower with abradable coating for increasing the volumetric efficiency of the rotary blower, and in particular to an abradable coating for a rotary lobe-type pump, compressor, or blower such as a Roots type rotary blower, typically used as an automotive supercharger.

2. Description of the Related Art

Although the present invention may be employed with various types of pumps, blowers, and compressors, such as a screw compressor, it is particularly advantageous when employed with a Roots type blower and will be described specifically in connection therewith, but the present invention is not intended to be limited thereto.

Rotary blowers of the Roots type typically include a pair of meshed, lobed rotors having either straight lobes or lobes with a helical twist with each of the rotors being mounted on a shaft, and each shaft having mounted thereon a timing gear. Rotary blowers, particularly Roots blowers are employed as superchargers for internal combustion engines and normally operate at relatively high speeds, typically in the range of 10,000 to 20,000 revolutions per minute (rpm) for transferring large volumes of a compressible fluid like air, but without compressing the air internally within the blower.

It is desirable that the rotors mesh with each other, to transfer large volumes of air from an inlet port to a higher pressure at the outlet port. Operating clearances to compensate for thermal expansion and/or bending due to loads are intentionally designed for the movement of the parts so that the rotors actually do not touch each other or the housing. Also, it has been the practice to epoxy coat the rotors such that any inadvertent contact does not result in the galling of the rotors or the housing in which they are contained. The designed operating clearances, even though necessary, limit the efficiency of the rotary blower by allowing leakage. This creation of a leakage path reduces the volumetric efficiency of the rotary blower.

In addition to the designed operating clearances limiting the volumetric efficiency of a rotary blower, manufacturing tolerances do exist and can limit the volumetric efficiency. While reducing or even eliminating the manufacturing tolerances can improve the performance and efficiency of the rotary blower, it is not always feasible from a cost perspective.

To enhance pumping efficiency and reduce fluid leakage, it is known to coat one or more of the moving parts of a pump, compressor or rotary blower with a coating material such as a fluoropolymer, for example, as described in U.S. Pat. Nos. 4,806,387 and 4,806,388. While these flexible, thermoplastic type coatings can improve efficiency to some degree, there are still operating clearances which limit the efficiency of the rotary blower.

Still another approach to improving pumping efficiency is the use of a coating with an abradable material. An abradable coating is a material which abrades or erodes away in a controlled manner. An abradable coating is typically employed where there is contact between a moving part and a fixed part, or in some cases where there is contact between two moving parts. As the part moves, a portion of the abradable material will abrade to an extremely close tolerance.

Abradable coatings have found particular application in axial flow gas turbines. The inner surface of the turbine shroud is coated with an abradable material. As the turbine blades rotate, they expand due to generated heat which causes the tips of the blades to contact and wear away the abradable material on the shroud for providing the necessary clearance with a tight seal.

U.S. Pat. Nos. 5,554,020 and 5,638,600 disclose applying an abradable coating to a fluid pump like a rotary blower, compressor, or an oil pump. The abradable coating comprises a polymer resin matrix with solid lubricants having a temperature stability up to 700° F. with a nominal coating thickness ranging from 12.5 to 25 microns.

While such coatings have improved the volumetric efficiency of rotary blowers, there still exists a need for an improved rotary blower with an abradable coating that has good adhesion to the rotor, and yet has sufficient lubricity. In addition to having good adhesion to the rotor and sufficient lubricity, the abradable coating should be chemically resistant to automotive related solvents. The lubricating properties of the abradable coating permit a sliding motion between the coated surfaces with a minimum generation of heat while transferring the large volumes of fluid. The abradable coating should still be sufficiently soft so that if any coating abrades away there is little or no contact noise. It is also desirable that the abradable coating be capable of being applied in either a liquid or dry form to the rotors. The abradable coating should significantly increase the volumetric efficiency of a meshed lobed rotary blower by minimizing leakage due to operating clearances.

BRIEF SUMMARY OF THE INVENTION

Accordingly, it is an object of the present invention to provide an improved rotary blower with an abradable coating for increasing the volumetric efficiency of the rotary blower Another object of the present invention is to provide for the use of an improved abradable coating for a lobed rotor of a rotary blower with a predetermined maximum hardness that has good adhesion to the rotor and sufficient lubricating properties.

Another object of the present invention to provide an improved abradable coating on the lobes of each rotor for providing essentially zero clearance to minimize any leakage therebetween for increasing volumetric efficiency of the rotary blower.

Another object of the present invention is to provide for the use of an improved abradable coating with sufficient lubricating properties to permit a sliding motion between the coated rotors with a minimum generation of heat when transferring large volumes of air.

Still another object of the present invention is to provide for the use of an improved abradable coating for a rotary blower which is sufficiently soft so that if any coating abrades away after a break-in period there is minimal, if any, contact noise.

A further object of the present invention is to provide for the use of an improved abradable coating that can be used for manufacturing an improved Roots type rotary blower in cost-effective, economical manner.

The above and other objects of the present invention are accomplished with the provision of an improved abradable coating on at least a portion of at least one of the lobed rotors in a rotary blower to increase the volumetric efficiency of the rotary blower. The abradable coating comprises a mixture of a coating matrix and a solid lubricant with a maximum hardness value of about 2H on a pencil hardness scale for providing an essentially zero operating clearance for the rotors in the rotary blower. This maximum hardness value achieves a good balance between hardness which offers good adhesion to the rotor and lubricity that permits the sliding motion between the rotors. Preferably, the coating matrix is an epoxy polymer resin in powder form mixed with graphite. The thickness of the abradable coating, prior to the initial break-in, is about 80 to about 130 microns, and preferably about 100 microns.

DETAILED DESCRIPTION OF THE INVENTION

Figure 1:
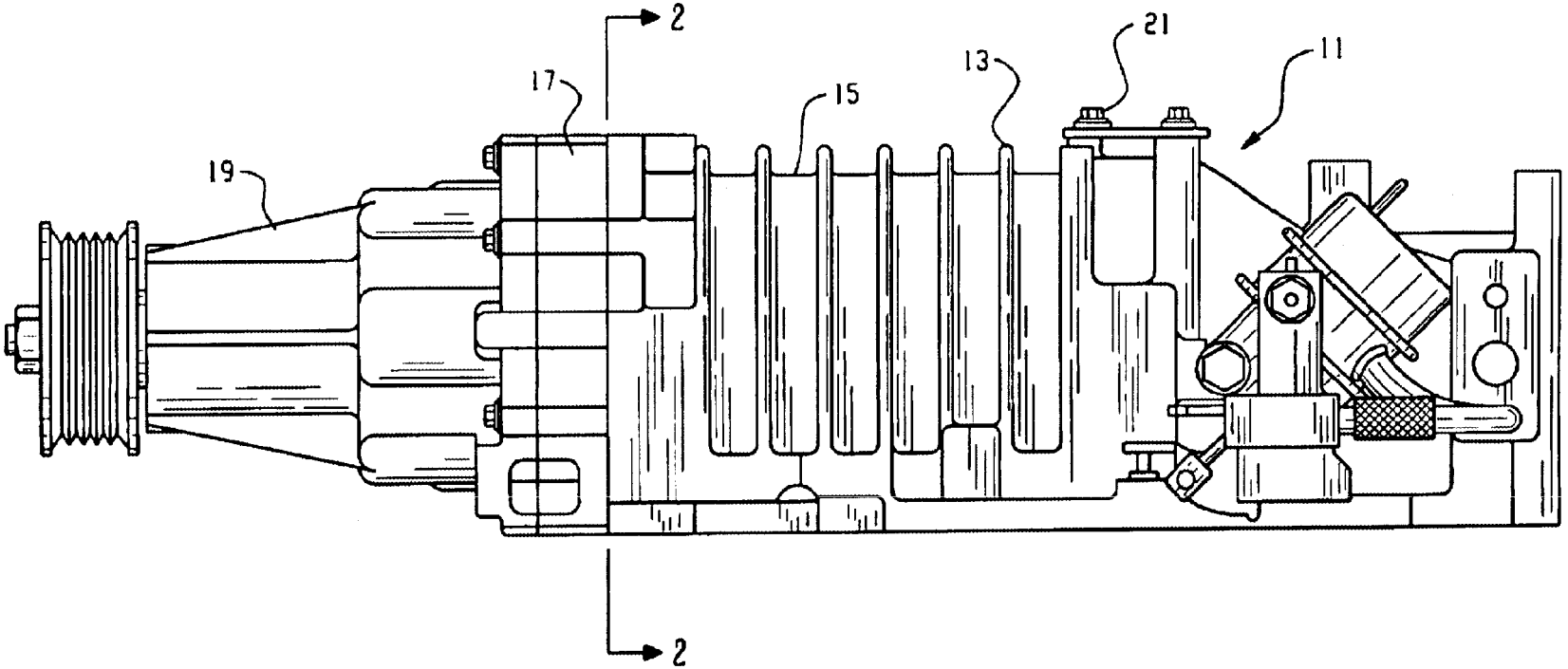
Fig. 1 PRIOR ART
FIG. 1 is a side elevation view of a Roots type rotary blower of the type with which the present invention is preferably utilized.

Referring now to the drawings, which are not intended to limit the present invention, and first in particular to FIG. 1, there is shown a rotary pump or blower of the Roots type, generally designated 11. Rotary blower 11 is illustrated and described in greater detail, and may be better understood by reference to U.S. Pat. Nos. 4,828,467; 5,118,268; and 5,320,508 all of which are assigned to the Assignee of the present invention and hereby incorporated by reference.

As is well known in the art, rotary blowers are used typically to pump or transfer volumes of a compressible fluid such as air from an inlet port opening to an outlet port opening without compressing the air in the transfer volumes prior to exposing it to higher pressure air at the outlet opening. Rotary blower 11 comprises a housing assembly 13 which includes a main housing member 15, bearing plate 17, and the drive housing member 19. The three members are secured together by a plurality of fasteners 21.

Figure 2:
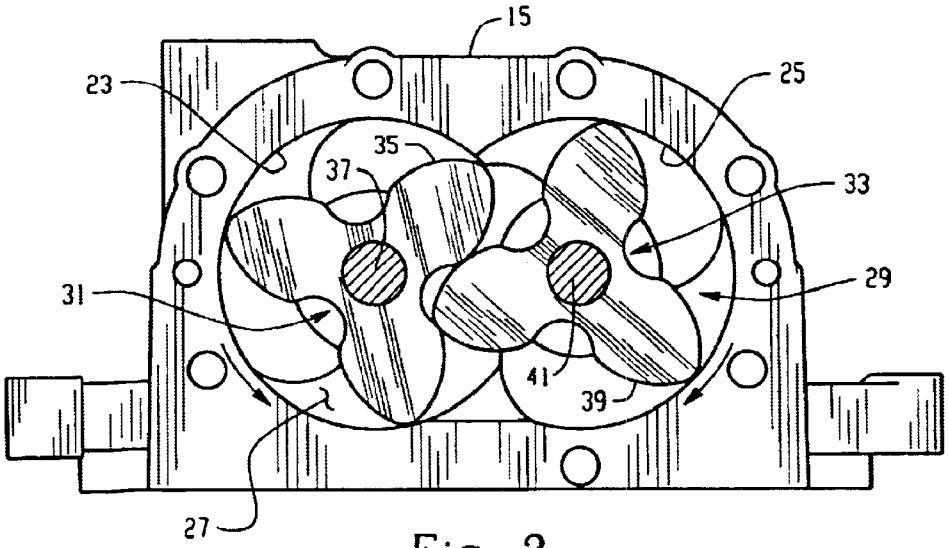
Fig. 2 PRIOR ART
FIG. 2 is a transverse cross-section taken on line 2—2 of FIG. 1.

Referring next to FIG. 2, the main housing member 15 is a unitary member defining cylindrical wall surfaces 23, 25 which define parallel transverse overlapping cylindrical chambers 27 and 29, respectively. Chambers 27, 29 have rotor-shaft subassemblies 31, 33, respectively mounted therein for counter-rotation, with axes substantially coincident with the respective axes of the blower 11 as is known in this art. Subassembly 31 has a helical twist in a counter-clockwise direction as indicated by the arrow adjacent reference numeral 31 in FIG. 2. The subassembly 33 has a helical twist in the clockwise direction as shown by the arrow adjacent reference numeral 39 in FIG. 2. For purposes of explaining the use of the abradable coating in accordance with the present invention, the subassemblies 31 and 33 will be considered identical, and only one will be described in reference to the use of the abradable coating hereinafter.

Figure 3:
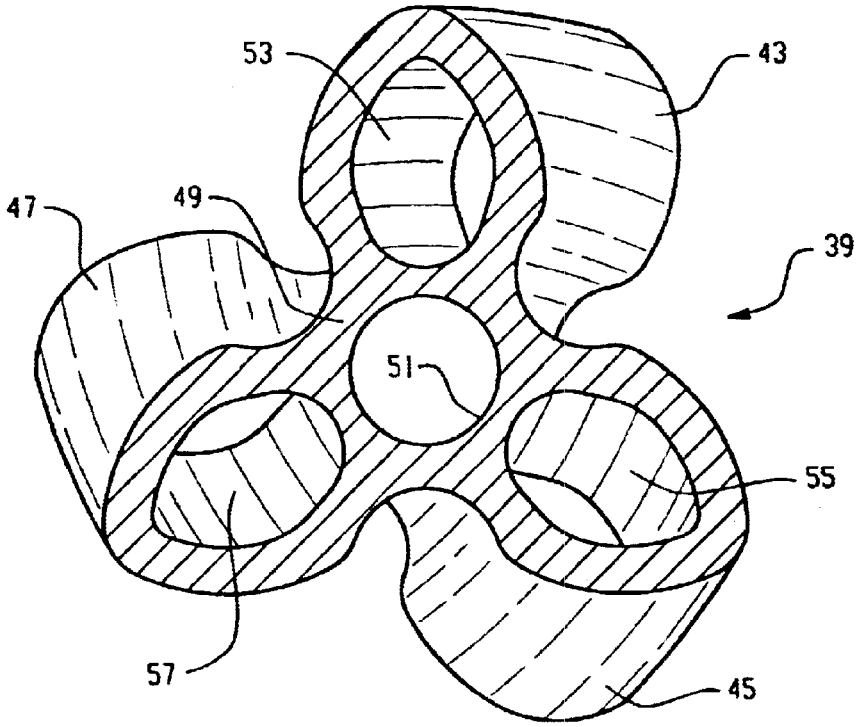
Fig. 3 PRIOR ART
FIG. 3 is a transverse cross-section of one of the rotors employed in a Roots type blower.

Turning next to FIG. 3, there is shown a cross-sectional view of rotor 39. The construction and manufacture of rotor 39 is described in far greater detail in the above-incorporated U.S. Pat. No. 5,320,508. Rotor 39 comprises three separate lobes 43, 45, and 47 which connect together, or preferably are formed integrally, to define a generally cylindrical web portion 49. Shaft 41 is disposed within a central bore portion 51. Each of the lobes 43, 45, and 47 may define hollow chambers 53, 55, 57, respectively therein, although the present invention is equally applicable to both solid and hollow rotors.

Figure 4:
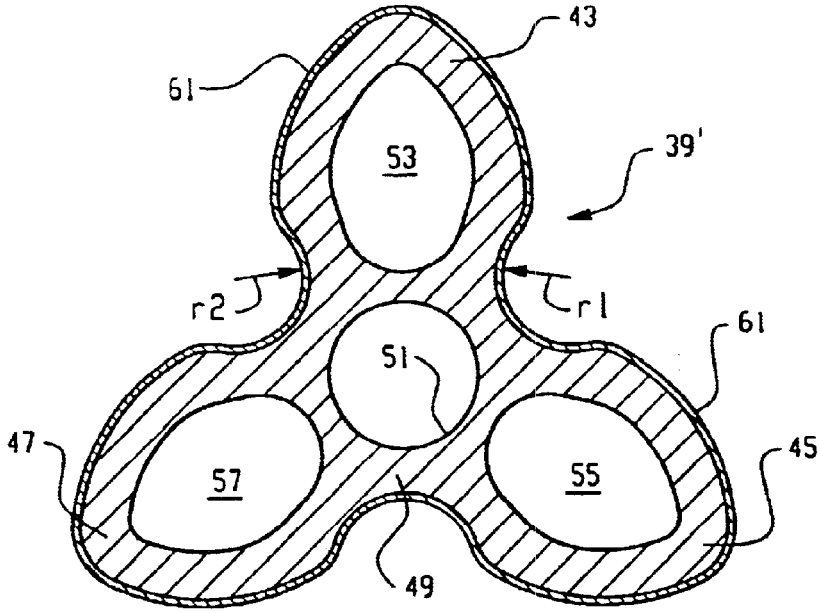
FIG. 4 is a transverse cross-section similar to FIG. 3 except the rotor is depicted with straight lobes for ease of illustration and depicts an abradable coating thereon in accordance with the present invention.

To facilitate a better understanding of the structure in accordance with the present invention and for ease of illustration FIG. 4 depicts rotor 39 as a straight lobed rotor. It should be understood that the present invention is equally applicable to any shaped rotor whether it is helical or straight lobed.

In FIG. 4, there is shown an abradable coating 61 preferably covering the entire outer surface of rotor 39'. Coating 61 comprises a mixture of a coating material base or matrix which is preferably an epoxy polymer resin matrix in powder form, (also referred to herein as a powder paint material) which will be described in greater detail hereinafter, and a solid lubricant. Suitable solid lubricants include, but are not limited to graphite, $CaF_2$, $MgF_2$, $MoS_2$, $BaF_2$ and BN. The coating mixture is then cured. Preferably, the surface temperature of the rotor is warmed to about 375° F. The coating has a temperature compatibility ranging from about −40° C. to about 200° C. The coating has a temperature stability of up to 400° F. The composition of coating 61 will be described in much greater detail hereinafter. As a minimum to provide at least some but are not limited to graphite, $CaF_2$, $MgF_2$, $MoS_2$, $BaF_2$ and BN. The coating mixture is then cured. Preferably, the surface temperature of the rotor is warmed to about 375° F. The coating has a temperature compatibility ranging from about −40° C. to about 200° C. The coating has a temperature stability of up to 400° F. The composition of coating 61 will be described in much greater detail hereinafter. As a minimum to provide at least some increase in volumetric efficiency, the abradable coating 61 should cover, by way of example only, at least the area from one root radius (r1) around the addendum to another root radius (r2) of each lobe 43, 45, and 47. More preferably, both rotors have the abradable coating 61 covering the entire outer surface thereof.

Figure 5:
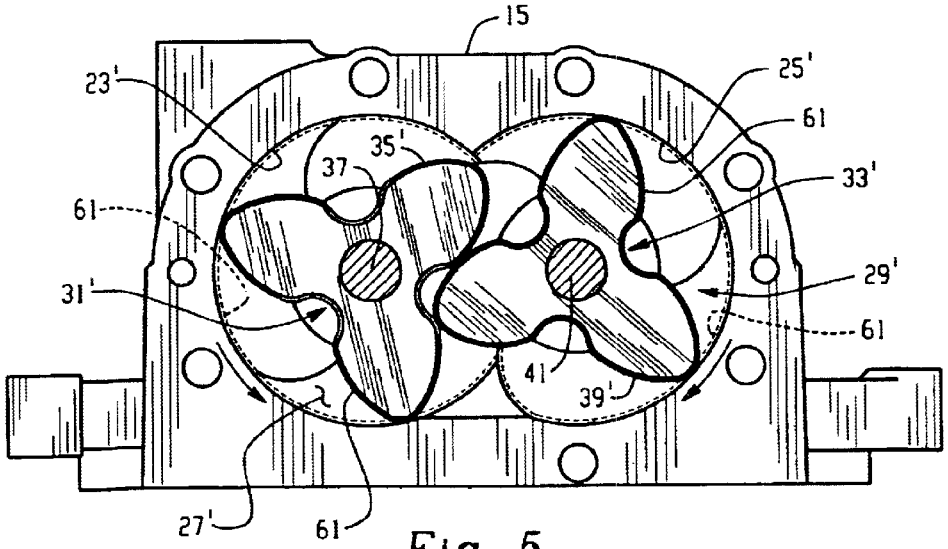
FIG. 5 is a view similar to that of FIG. 2 depicted with an improved abradable coating in accordance with the present invention.

A conventional rotary blower without an abradable coating, as depicted in FIG. 2, is designed with operating clearances ranging from about 6 mils to about 10 mils from rotor to rotor, and from about 3 mils to about 5 mils from rotor to housing (25 microns is approximately equal to 1 mil). The coating according to the present invention is deposited in a controlled thickness ranging from about 80 microns ($\mu$m) to about 130 ($\mu$m) with a thickness of about 100 ($\mu$m) preferred. The coated rotors can have clearances due to manufacturing tolerances that may range from rotor to rotor from about 0 mils to about 7 mils, and rotor to housing that may range from about 0 mils to about 3 mils. Preferably, the thickness of the abradable coating material on the rotors is such that there is a slight interference fit between the rotors and the housing. During the assembly process, the rotary blower is operated on line for a brief break-in period. The term "break-in" as used herein is intended to refer to an operation cycle which lasts as a minimum approximately two minutes where the rotary blower undergoes a ramp from about 2000 rpm to about 16,000 rpm, and then back down. Of course, the break-in period can include but is not limited to any operation cycle employed to abrade the coating to an essentially zero operating clearance. The term "essentially zero operating clearance" as used herein is meant to include but is not limited to the maximum operating clearance for a rotary blower that still provides a significant As can be seen in FIG. 5, the abradable coating 61 may optionally be provided on the cylindrical wall surfaces 23' and 25' (shown in dashed lines).

The coating is preferably applied with an electrostatic or air atomized spray process, but may also be applied with a liquid process such as a liquid spraying, dipping, or rolling process. Even though a spray coating process applied with an evaporative vehicle enables improved thickness uniformity and repeatability compared to the electrostatic powder coating process, an environmental concern is volatile organic compounds (VOC). The VOC content is preferably less than 0.5 lbs./gallon. The adhesion of the coating on the rotor or cylindrical wall surface can be improved with surface preparation of the substrate by mechanical means such as machining, sanding, grit blasting or the like, or alternatively with chemical means for surface treatment such as etching, degreasing, solvent cleaning or chemical treatment such as an alkaline or phosphate wash, all of which is well known in the coating art.

It is desirable for the coating to maintain its structure without peeling at contact areas, and to have good adhesion to aluminum or other lightweight metals. Also, the abradable coating material should not be harmful to the catalytic converter or the heat exhaust gas oxygen (HEGO) sensor if any particles become entrained into the engine after the break-in period. As such, the coating particles do need to be combustible. In addition, the coating also should have compatibility with gasoline, oil, water, alcohol, exhaust gas, Nye® #605 synthetic lubricating oil; Nye is a registered trademark of William F. Nye, Inc., oil or any other automotive solvent.

In the development of the blower which uses the preferred abradable powder coating material of the present invention, a variety of coating materials were investigated. Table 1 lists the results of several of these coating materials.

TABLE I

| | COATING MATERIALS | | |
|---|---|---|---|
| | DESIRED PARAMETER | ONE PART URETHANE | TWO PART URETHANE |
| PRODUCT DESCRIPTION | | 1 prt-latex + polycarbarbonate urethane + add graphite or PTFE | 2 prt polyester urethane + add graphite or PTFE |
| APPLICATIONS | | tailor to Rotor needs | tailor to Rotor needs |
| NOMINAL THICKNESS | 0.0015" min, no max | 0.002" one coat | 0.002" one coat |
| OPERATING TEMPERATURE | −40 to 160 C. (−40 to 320 F.) | ~390 F. | ~390 F. |
| CHEMICAL RESISTANCE | EGR (exhaust), water, oil, fuel, grease | good/adjustable | very good |
| ABRADABILITY | Abrade quickly during break-in so contact discontinues. | yes - pigment will modify, tailorable | Urethane may be too flexible, - pigment may improve |
| LUBRICITY | Minimize squeal during contact | yes - from pigment - tailorable | yes - from pigment - tailorable |
| THICKNESS UNIFORMITY AND REPEATABILITY | +, −0.0005" | process dependant | process dependant |
| ADHESION TO ALUMINUM | Must stick in non-contact areas permanently | adjustable with urethane content | very good |
| SURFACE PREPARATION | Prefer phosphate wash only | phosphate wash | phosphate wash |
| PROCESS | Dip Or Spray + Bake | Spray | mix at nozzle spray |
| MAXIMUM CURE TEMP | 400 F. (350 F. better) | force air dry ~150 F. | force air dry ~150 F. |
| ENVIRONMENTAL FACTORS | Water based is best. Low VOC's are preferred | 1.5 lb/gal VOC | ~zero VOC |

| | SAMPLE 1 | SAMPLE 2 | SAMPLE 3 | SAMPLE 4 |
|---|---|---|---|---|
| PRODUCT DESCRIPTION | RTV silicone + add Graphite | Silicone + add graphite | Waterborne solid film lubricant + $MoS_2$ | Water based, resin bonded, lubricant coating with PTFE |
| APPLICATIONS | Electronics protection | | Solid film lube | Sol. Film Lube |
| NOMINAL THICKNESS | .002 +/ coat | .002 +/ coat | Poss 0.015/coat | .0008–.001" coat (0.002 max) |
| OPERATING TEMPERATURE | OK | 1000 F. | Ok | Ok |

TABLE I-continued

| | | | | |
|---|---|---|---|---|
| CHEMICAL RESISTANCE | Expected | Expected | Expected | Ok Expected |
| ABRADABILITY | Yes | Yes | Designed to stay | Designed to stay |
| LUBRICITY | Ok | Ok | Good | Good |
| THICKNESS UNIFORMITY AND REPEATABILITY | process dependant | process dependant | process dependant | process dependant |
| ADHESION TO ALUMINUM | Ok | Ok | Should be Ok | Expected |
| SURFACE PREPARATION | | | phosphate | Degrease |
| PROCESS | Spray, moisture cures in ~20 min | Spray | Spray | Spray/dip |
| MAXIMUM CURE TEMP | | Ambient to 120 F. | 300–400 60 min. | 300 F. 30 min |
| ENVIRONMENTAL FACTORS | 1 + thinner product = ~1 | 0.46 lb/gal VOC | 2 lb/gal | 2 lb/gal |

The results in Table 1 show that a variety of materials may be employed to produce an abradable coating, for example, urethane works well with graphite or waxy fluoropolymer additives for abradability and lubricity.

The urethane used in the coating matrix is commercially available from Freda, Inc. Two different types of water based urethane systems were tested as a coating matrix: a one-part urethane, and a two-part urethane. Urethane resins, which contain polyols, become crosslinked polymeric structures when isocyanates react with polyols. Polyols can be acrylics, carboxyls, polyesters, or other monomer groups that have reactive hydroxyl (OH) sites. This crosslinking reaction occurs at room temperature, and can be accelerated by heating to approximately the 150° F. temperature range. Curing above approximately 190° F. leads to swelling of the coating, and should be avoided. Once urethanes are cured, they are dimensionally and chemically stable up to about 350° F. or higher.

One-part urethanes are basically a water based system with polycarbonates and with 5 to 10% (on a volume basis) polyurethane added. The two-part urethane system is also a water based system with polyester polyol and fillers. The two-part urethane system has better adhesion, flexibility, and chemical resistance compared to the one-part urethane system.

Silicone based industrial coatings are also commercially available, but a possible concern is that silicone based oils may damage HEGO sensors. These relatively soft base materials cure quickly after spraying and are similar to room temperature vulcanized rubber (RTV). Silicone based coatings may be loaded with fillers for abradability and lubricity, and have excellent temperature resistance (<about 500° F.) as well as good chemical resistance. If any abraded material remaining after the break-in period enters the combustion chamber, it combusts into a substance like silica ($SiO_2$).

While the coating matrix materials in Table 1 are alternate embodiments for the coating matrix of the abradable powder coating used in accordance with the present invention, Table II lists several preferred coating matrix materials and their characteristics. The silicone co-polymer base coating matrix is commercially available from Dampney Company Inc., and the silicone polymer base coating matrix is commercially available from Elpaco Coatings Corp. The water-based resin bonded lubricant coating is available from Acheson Colloids Company. The waterborne solid film lubricant and $MoS_2$ is commercially available from Sandstrom Products Company. Of these materials, the most preferable coating matrix is the epoxy-polymer resin matrix in powder form, also commonly referred to as an epoxy powder paint material. The epoxy-polymer resin matrix is mixed with graphite powder. The preferred coating material is commercially available from Flow Coatings LLC of Waterford, Michigan, Catalog #APC-2000. The preferred coating material has a median particle size of approximately 30 microns. During the curing process, particles link together to create a coarse spongy layer that easily abrades. When the particle size is less than about 10 microns, during the curing step, the powder turns to a liquid and flows out which causes the coating to form a continuous sheet. This type of coating may still be used, but is not preferred.

TABLE II

| | | COATING MATERIALS | | | |
|---|---|---|---|---|---|
| CHARACTERISTIC | REQUIREMENT | EPOXY POWDER | EPOXY + GRAPHITE POWDER | SILICONE CO-POLYMER + GRAPHITE | SILICONE POLYMER + GRAPHITE |
| Functional/ Performance | | Epoxy cure | Epoxy cure | | |
| Coating Thickness | 0.0024 in (63 $\mu$m) | 2 to 4 mils | 2 to ~6 mils | 2 to ~5 mills | 2 to ~3 mils |
| Prevent Galling/ Seizing in Contact Event | Line to line aluminum stack-up design prevents galling also | OK | OK | OK | OK |

TABLE II-continued

| CHARACTERISTIC | REQUIREMENT | COATING MATERIALS | | | |
|---|---|---|---|---|---|
| | | EPOXY POWDER | EPOXY + GRAPHITE POWDER | SILICONE CO-POLYMER + GRAPHITE | SILICONE POLY-MER + GRAPHITE |
| Minimize Noise, Slap & Squeal during contact | Should abrade or conform at contact areas so noise ceases during end of line testing | Contact noise is persistent because coating remains | Abrasion is expected to quickly improve noise at tight timing gaps | Observation - noise not problem at tight gaps due to abrasion | Observation - noise not problem at tight gaps due to abrasion |
| Temperature Stability | −40 to + 160 C. | OK | −40 + 160 C. OK, Expected | −40 + 160 C. OK, Expected | −40 + 160 C. OK, Expected |
| Chemical resistance | Water, antifreeze, oil, Nye 605, gas, EGR exhaust, Rheotemp 500, alcohols | Excellent | Excellent | OK - slightly more abradable while wet with gasoline | OK - slightly more abradable while wet with gasoline |
| System Compatibility | Ok for engine, Ox sensor, catalyst | OK | Expected OK | Expected OK | Expected OK |
| Stability | No water absorption, no creep, shrink | OK | OK - poss absorption if same porosity is present | OK - poss absorption if same porosity is present | OK - poss absorption if porosity |
| Adhesion strength | ASTM D3359, Stick to 18K RPM | Excellent | Adequate | Adequate | Adequate |
| Hardness | Softer than base Al alloy. Must abrade/ conform | Very Hard - can smear, but does not abrade | Hard, but readily abradable through roughness layer can flake | Readily abradable, can flake off in heavy contact. | Readily abradable, can flake off in heavy contact |
| Expansion Compatibility with Al | Al 2.1–2.3 ee-6/ deg C. | OK | OK | OK | OK |
| Surface finish/ roughness | Rough may be best | Like eggshell, glossy | Always rough - as 80 grit | Smooth or rough | Smooth or rough |
| Color | No Requirement | Silver-grey | Black | Black | Black |
| Process Type | Uniformity & Robust | Electrostatic Spray | Electrostatic Spray | Liquid Spray HVLP | Liquid Spray HVLP |
| Environmental/ Health Concern | <0.5 lb/gal VOC/ health requirements TBD | No VOC's/ Health OK | No VOC's/ Health OK | Low enough VOC's/ Health Looks OK | Low enough VOC's/ Health Looks OK |
| Cure Requirements | No Metallurgical Change, No movement on shaft, ,350 F., lower is best | 1 min IR, 7 min. @ 350 F. convection, some movement on shaft | 1 min IR, 7 min. @ 350 F. convection | Flash off all water, 10 min at 300 F. | Flash off all water, 10 min at 300 F. |
| Surface Preparation | No grit, prefer alkaline/phosphate wash and sealer | Baseline-phosphate wash & sealer | Baseline process OK | Baseline process OK | Baseline process OK |

As mentioned earlier, one of the key ingredients in the coating matrix is the solid lubricant. The solid lubricant functions as a filler with lubricating properties. Adding large amounts of graphite to the coating matrix provides a lubricating effect. However, the amount of graphite added also affects the hardness of the coating, i.e., the higher the graphite content the lower the coating hardness. The softer coating generates less noise if contact occurs, but the addition of too much graphite to the coating can affect adhesion and result in delamination during high-speed rotation. Consequently, a balance is necessary to achieve good adhesion and suitable hardness. The graphite content controls the abradability, adhesion, and flake resistance of the abradable coating.

For purposes of the present invention, hardness value is measured according to American Society of Testing Material ASTM D-3363 which is referred to as "pencil hardness". The term "pencil hardness" as used herein is meant to include but not be limited to a surface hardness defined by the hardest pencil grade that just fails to mar the painted or coated surface. The abradable coating according to the present invention has a maximum hardness value of approximately 2H. The minimum hardness value is approximately 4B. A preferred hardness value is approximately B. A more preferred hardness value is approximately 2B.

Figure 6:
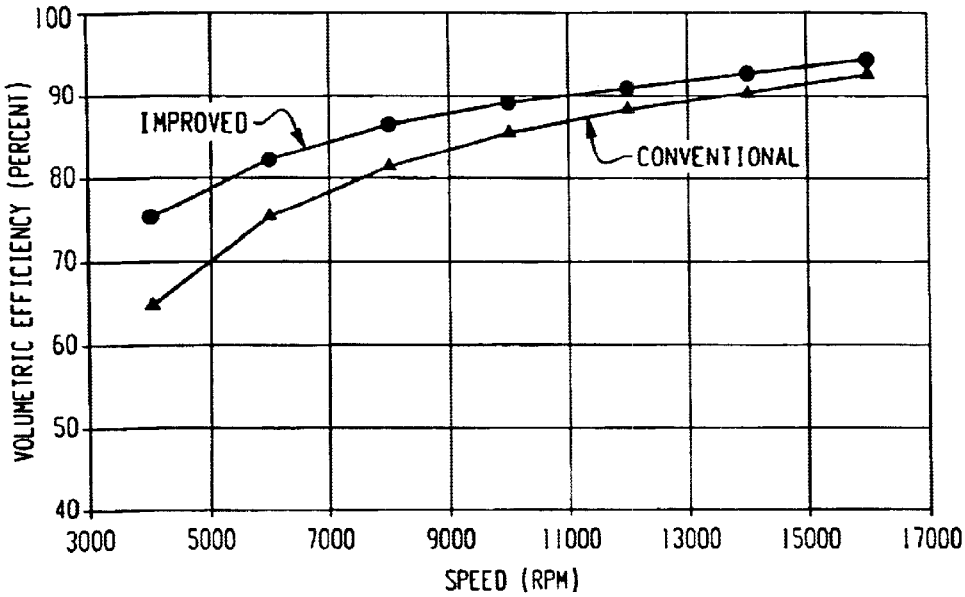
FIG. 6 is a performance plot of a conventional rotary blower and an improved rotary blower in accordance with the present invention at a pressure of 0.35 bar (5 psi boost pressure).
Figure 7:
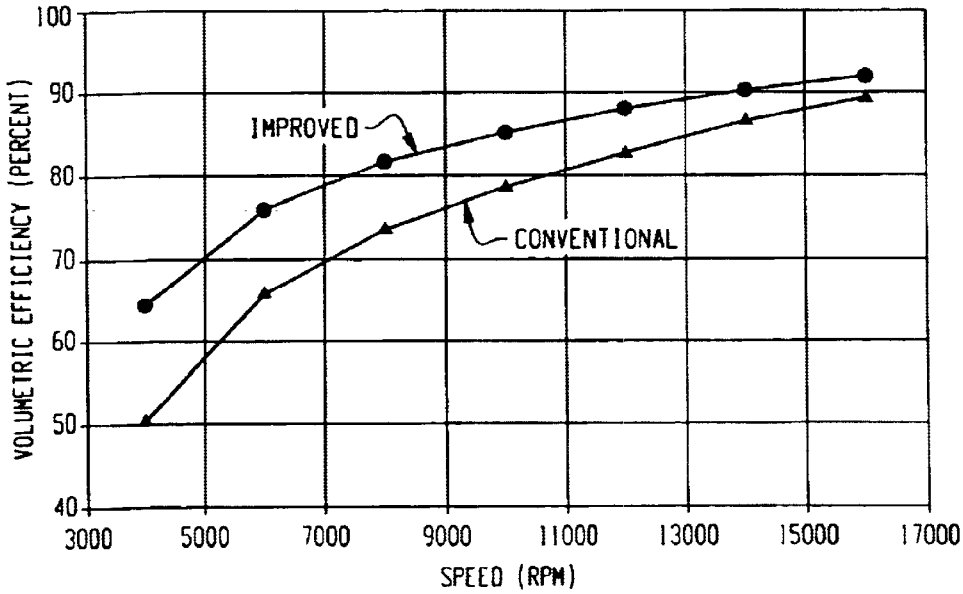
FIG. 7 is a performance plot similar to FIG. 6 except at a pressure of 0.69 bar (10 psi boost pressure).

Advantageously, the abradable coating provides a significant increase in the volumetric efficiency of the rotary blower as shown in FIGS. 6 and 7. FIG. 6 is a graph of volumetric efficiency in percent versus the speed in revolutions per minute (rpm) for a conventional rotary blower (labeled "conventional") without the abradable coating as shown in the lower plot on the graph, and an improved rotary blower (labeled "improved") with the abradable powder coating in accordance with the present invention. At a low speed of approximately 4,000 rpm, there is approximately a 15 percent increase in volumetric efficiency. Even more positive results (approximately a 30 percent increase) are obtained at a higher pressure of 0.69 bar as shown in FIG. 7.

While specific embodiments of the invention have been shown and described in detail, to illustrate the application and the principles of the invention, it will be understood that the invention may be embodied otherwise departing from such principles.

We claim:

1. In a rotary blower having a pair of meshed, lobed rotors, the improvement comprises an abradable coating on at least a portion of at least one of the lobed rotors for providing an essentially zero operating clearance for increasing a volumetric efficiency of the rotary blower, said abradable coating being a mixture of a coating matrix and a solid lubricant, said coating matrix having a VOC of less than or equal to about 0.5 lb/gal, said abradable coating having a maximum hardness value of approximately 2H on the pencil hardness scale, and said abradable coating having a temperature stability of up to about 400° F.

2. The improved rotary blower as recited in claim 1, wherein said abradable coating comprises a minimum hardness value of approximately 4B on the pencil hardness scale.

3. The improved rotary blower as recited in claim 1, wherein said abradable coating has a thickness ranging from about 80 microns to about 130 microns.

4. The improved rotary blower as recited in claim 3, wherein said abradable coating is approximately 100 microns thick.

5. The improved rotary blower as recited in claim 1, wherein said coating material of said abradable coating comprises an epoxy powder.

6. The improved rotary blower as recited in claim 5, wherein said solid lubricant comprises graphite.

7. The improved rotary blower as recited in claim 1, wherein said coating matrix is a member selected from the group consisting of an epoxy, a urethane, a silicone polymer, and a silicone co-polymer.

8. The improved rotary blower as recited in claim 1, wherein said abradable coating has a hardness value of approximately 2B on the pencil hardness scale.

9. The improved rotary blower as recited in claim 1, wherein said abradable coating has a hardness value of approximately B on the pencil hardness scale.

10. In a rotary blower having a pair of meshed, lobed rotors, the improvement comprises an abradable coating on at least a portion of at least one of the lobed rotors for providing an essentially zero operating clearance for increasing a volumetric efficiency of the rotary blower, said abradable coating being a mixture of an abradable powder coating matrix and a solid lubricant, said coating matrix having a VOC of less than or equal to about 0.5 lb/gal, said abradable coating having a maximum hardness value of approximately 2H on the pencil hardness scale.

11. The improved rotary blower as recited in claim 10, wherein said abradable coating comprises a minimum hardness value of approximately 4B on the pencil hardness scale.

12. The improved rotary blower as recited in claim 10, wherein said abradable coating has a thickness ranging from about 80 microns to about 130 microns.

13. The improved rotary blower as recited in claim 12, wherein said abradable coating is approximately 100 microns thick.

14. The improved rotary blower as recited in claim 10, wherein said abradable powder coating material of said abradable coating comprises an epoxy powder.

15. The improved rotary blower as recited in claim 10, wherein said solid lubricant comprises graphite.

16. The improved rotary blower as recited in claim 10, wherein said abradable coating has a hardness value of approximately 2B on the pencil hardness scale.

17. The improved rotary blower as recited in claim 10, wherein said abradable coating has a hardness value of approximately B on the pencil hardness scale.

18. In a rotary blower having a pair of meshed, lobed rotors, the improvement comprises an abradable coating on at least a portion of at least one of the lobed rotors for providing an essentially zero operating clearance for increasing a volumetric efficiency of the rotary blower, said abradable coating being a mixture of a coating matrix and a solid lubricant, said abradable coating having a maximum hardness value of approximately 2H on the pencil hardness scale, said abradable coating having a particle size greater than 10 microns, and said coating matrix has a VOC of less than or equal to about 0.5 lb/gal.

19. The improved rotary blower as recited in claim 18, wherein said abradable coating comprises a minimum hardness value of approximately 4B on the pencil hardness scale.

20. The improved rotary blower as recited in claim 18, wherein said abradable coating has a thickness ranging from about 80 microns to about 130 microns.

21. The improved rotary blower as recited in claim 18, wherein said abradable coating has a median particle size of approximately 30 microns.

* * * * *